US008872736B2

(12) United States Patent
Shin

(10) Patent No.: US 8,872,736 B2
(45) Date of Patent: Oct. 28, 2014

(54) AMOLED DISPLAY AND DRIVING METHOD THEREOF

(75) Inventor: Dong-Yong Shin, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 1874 days.

(21) Appl. No.: 10/985,795

(22) Filed: Nov. 11, 2004

(65) Prior Publication Data

US 2005/0116656 A1 Jun. 2, 2005

(30) Foreign Application Priority Data

Nov. 27, 2003 (KR) ..... 10-2003-0084779

(51) Int. Cl.
*G09G 3/30* (2006.01)
*G09G 3/32* (2006.01)

(52) U.S. Cl.
CPC ..... *G09G 3/3233* (2013.01); *G09G 2300/0861* (2013.01); *G09G 2300/0842* (2013.01); *G09G 2310/061* (2013.01); *G09G 3/3266* (2013.01); *G09G 2300/0804* (2013.01); *G09G 2330/025* (2013.01)
USPC ..... 345/76; 345/77; 345/78; 345/79; 345/80; 345/81; 345/204

(58) Field of Classification Search
USPC ..... 345/76, 100, 204
See application file for complete search history.

(56) References Cited

U.S. PATENT DOCUMENTS 3,614,766 A * 10/1971 Kievit ..... 345/685
5,742,267 A * 4/1998 Wilkinson ..... 345/77
5,859,630 A * 1/1999 Huq ..... 345/100
5,883,609 A * 3/1999 Asada et al. ..... 345/100
6,392,620 B1 * 5/2002 Mizutani et al. ..... 345/88
6,400,101 B1 * 6/2002 Biebl et al. ..... 315/291
6,411,045 B1 6/2002 Nerone (Continued)

FOREIGN PATENT DOCUMENTS

CN 1326175 A 12/2001
CN 1361651 A 7/2002

(Continued)

OTHER PUBLICATIONS

Patent Abstracts of Japan, Publication No. 2000-227784, dated Aug. 15, 2000, in the name of Masaya Ishii et al.

(Continued)

*Primary Examiner* — Grant Sitta
(74) *Attorney, Agent, or Firm* — Christie, Parker & Hale, LLP

(57) ABSTRACT

An emission control circuit for controlling emission of R, G, B EL elements and method for driving an organic light emitting diode display using the same. An emission control signal generating circuit of a flat panel display includes a plurality of pixels. Each pixel includes a plurality of EL elements, and emission of the elements is controlled by emission control signals. The circuit includes a first signal generating device for generating one of the emission control signals, and a plurality of second signal generating devices for generating other ones of the emission control signals using an output signal of the first signal generating device and an external control signal. The first signal generating device may include a shift register. Each of the plurality of second signal generating devices may include a NAND gate using the external signal and the external control signal, or an inverted signal thereof, as two inputs.

15 Claims, 10 Drawing Sheets

(56) References Cited

U.S. PATENT DOCUMENTS

| | | | | |
|---|---|---|---|---|
| 6,552,709 | B1 * | 4/2003 | Yamaguchi | 345/99 |
| 6,670,943 | B1 * | 12/2003 | Ishii et al. | 345/100 |
| 6,897,884 | B2 * | 5/2005 | Tsuge et al. | 345/690 |
| 6,903,731 | B2 * | 6/2005 | Inukai | 345/204 |
| 7,221,092 | B2 | 5/2007 | Anzai et al. | |
| 7,394,444 | B2 * | 7/2008 | Kim et al. | 345/87 |
| 2002/0012008 | A1 | 1/2002 | Takagi | |
| 2002/0118158 | A1 | 8/2002 | Yamamoto et al. | |
| 2002/0167504 | A1 * | 11/2002 | Matsumoto | 345/204 |
| 2003/0098827 | A1 * | 5/2003 | Ozawa et al. | 345/76 |
| 2003/0117348 | A1 * | 6/2003 | Knapp et al. | 345/76 |
| 2004/0239658 | A1 * | 12/2004 | Koyama et al. | 345/204 |
| 2004/0263499 | A1 * | 12/2004 | Tanada et al. | 345/204 |

FOREIGN PATENT DOCUMENTS

| | | | |
|---|---|---|---|
| EP | 1 061 497 | A1 | 12/2000 |
| JP | 2000-227784 | | 8/2000 |
| JP | 2001-60076 | | 3/2001 |
| JP | 2002-297083 | * | 10/2002 |
| JP | 2003-122301 | | 4/2003 |
| JP | 2003-131619 | | 5/2003 |
| JP | 2003-202834 | | 7/2003 |
| JP | 2003-233348 | | 8/2003 |
| JP | 2003-255899 | | 9/2003 |
| WO | WO 2004/061807 | | 7/2004 |

OTHER PUBLICATIONS

Patent Abstracts of Japan, Publication No. 2002-297083, dated Oct. 9, 2002, in the name of Hideto Kitakado et al.

Patent Abstracts of Japan, Publication No. 2003-122301, dated Apr. 25, 2003, in the name of Hajime Akimoto et al.

Patent Abstracts of Japan, Publication No. 2003-131619, dated May 9, 2003, in the name of Hanari Atsushi.

Patent Abstracts of Japan, Publication No. 2003-202834, dated Jul. 18, 2003, in the name of Hajime Kimura.

Patent Abstracts of Japan, Publication No. 2003-255899, dated Sep. 10, 2003, in the name of Hiroshi Tsuchiya et al.

Patent Abstract of Japan, Publication No. 2001-060076, Published on Mar. 6, 2001, in the name of Sekiya et al.

* cited by examiner

AMOLED DISPLAY AND DRIVING METHOD THEREOF

CROSS-REFERENCE TO RELATED APPLICATION

This application claims priority to and the benefit of Korean Patent Application No. 2003-84779, filed Nov. 27, 2003, the disclosure of which is incorporated herein by reference in its entirety.

BACKGROUND OF THE INVENTION

1. Field of the Invention

The present invention relates to an organic light emitting diode, and more particularly, to an active matrix organic light emitting diode (AMOLED) display and method for driving the same, which has a simplified configuration of an emission control signal generating circuit.

2. Description of the Related Art

In recent years, a liquid crystal display (LCD) and an organic light emitting diode (OLED) display are widely used in a portable information terminal due to advantages of light weight, thin size, and the like. The OLED display is being recognized as a next generation flat panel display because it has brightness and viewing angle characteristics superior to the LCD.

Typically, in an active matrix organic light emitting diode (AMOLED) display, one pixel includes R, G and B unit pixels, and each of the unit pixels has an electroluminescent (EL) element. The EL elements have R, G, and B organic emission layers interposed between an anode electrode and a cathode electrode thereof, respectively, which emit light in response to the voltage applied to the anode and cathode electrodes.

FIG. 1 shows a configuration of a conventional AMOLED display 10.

Referring to FIG. 1, the conventional AMOLED display 10 includes a pixel portion 100, a gate line driving circuit 110, a data line driving circuit 120, and an emission control signal generating circuit 190. The pixel portion 100 includes a plurality of gate lines 111-11*m* provided with scan signals S1-Sm from the gate line driving circuit 110, and a plurality of data lines 121-12*n* for providing data signals DR1, DG1, DB1-DRn, DGn, DBn from the data line driving circuit 120. In addition, the pixel portion 100 includes a plurality of emission control lines 191-19*m* for providing emission control signals output from the emission control signal generating circuit 190, and a plurality of power supply lines 131-13*n* for providing power supply voltage VDD1-VDDn.

In the pixel portion 100, a plurality of pixels P11-Pmn are arranged in a matrix format, and are connected to the plurality of gate lines 111-11*m*, the plurality of data lines 121-12*n*, the plurality of emission control lines 191-19*m*, and the plurality of power supply lines 131-13*n*. Each of the pixels P11-Pmn includes three unit pixels, namely R, G, B unit pixels PR11, PG11, PB11-PRmn, PGmn, PBmn, and is connected to corresponding ones of the gate lines, the data lines, the emission control lines and the power supply lines.

For example, the pixel P11 includes the R unit pixel PR11, the G unit pixel PG11, and the B unit pixel PB11, and is connected to a first gate line 111 for providing a first scan signal S1 among the plurality of gate lines 111-11*m*, a first data line 121 among the plurality of data lines 121-12*n*, and a first power supply line 131 among the plurality of power supply lines 131-13*n*.

In other words, the R unit pixel PR11 of the pixel P11 is connected to the first gate line 111, the R data line 121R of the first data line 121 provided with the R data signal DR1, and the R power supply line 131R of the first power supply line 131. In addition, the G unit pixel PG11 is connected to the first gate line 111, the G data line 121G of the first data line 121 provided with the G data signal DG1, and the G power supply line 131G of the first power supply line 131. Further, the B unit pixel PB11 is connected to the first gate line 111, the B data line 121B of the first data line 121 provided with the B data signal DB1, and the B power supply line 131B of the first power supply line 131.

The above-mentioned emission control signal generating circuit 190 includes three emission control signal generating devices for R, G, B, which provide the R, G, B subpixels PR11-PRmn, PG11-PGmn, and PB11-PBmn with emission control signals, respectively, as disclosed in the Japanese Patent Publication No. 2001-60076. Since each of the R, G, B emission control signal generating devices includes a shift register, the number of elements becomes larger and a circuit area also becomes larger. As a result, a failure rate increases and the yield decreases.

SUMMARY OF THE INVENTION

An exemplary embodiment according to the present invention provides an organic light emitting diode (OLED) display suitable for fine pitch and a method for driving the same.

Another exemplary embodiment according to the present invention provides an OLED display having a simplified emission control signal generating circuit and a method for driving the same.

Yet another exemplary embodiment of the present invention provides an OLED display capable of lengthening the lifetime by adjusting a current flowing through the EL element and a method for driving the same.

In an exemplary embodiment according to the present invention, an emission control signal generating circuit of a flat panel display is provided. The emission control signal generating circuit includes a plurality of pixels, each said pixel including a plurality of EL elements. Emission of the elements is controlled by a plurality of emission control signals. The circuit includes a first signal generating device for generating one of the plurality of emission control signals as an output signal, and a plurality of second signal generating devices for generating other ones of the plurality of emission control signals using the output signal of the first signal generating device and an external control signal.

The first signal generating device for generating said one of the plurality of emission control signals may include a shift register. One of the plurality of second signal generating devices may include a NAND gate having the external control signal and the output signal of the first signal generating device as two inputs, and another one of the plurality of second signal generating devices may include a NAND gate having an inverted signal of the external control signal and the output signal of the first signal generating device as two inputs.

One of the plurality of second signal generating devices may include a first transfer gate for providing the output signal of the first signal generating device as one of said other ones of the plurality of emission control signals using the external control signal having a first level and an inverted signal of the external control signal having a second level, and a second transfer gate for allowing said one of said other ones of the plurality of emission control signals to have the second level using the external control signal having the second level and the inverted signal of the external control signal having the first level. Another one of the plurality of second signal generating devices may include a third transfer gate for providing the output signal of the first signal generating device as another one of said other ones of the plurality of emission control signals using the external control signal having the second level and the inverted signal of the external control signal having the first level, and a fourth transfer gate for allowing said another one of said other ones of the plurality of emission control signals to have the second level using the external control signal having the first level and the inverted signal of the external control signal having the second level.

The plurality of EL elements may be sequentially driven per each of subframes that form one frame and may be in a black color state, or one of the plurality of EL elements may be driven again, during one of the plurality of subframes.

In another exemplary embodiment according to the present invention, an emission control signal generating circuit of an organic light emitting diode display including a plurality of pixels is provided. Each said pixel includes R, G, B EL elements, and emission of said elements is controlled by R, G, B emission control signals. The circuit includes a shift register for generating the G emission control signal as an output signal. The circuit also includes a first NAND gate for generating the R emission control signal using the output signal of the shift register and an external control signal as two inputs. An inverting gate inverts the external control signal to generate an inverted external control signal, and a second NAND gate generates the B emission control signal using the inverted external control signal and the output signal of the shift register as two inputs.

In yet another exemplary embodiment according to the present invention, an emission control signal generating circuit of an organic light emitting diode display including a plurality of pixels is provided. Each said pixel includes R, G, B EL elements, and emission of said elements is controlled by R, G, B emission control signals. The circuit includes an inverting gate for inverting an external control signal to generate an inverted external control signal, and a shift register for generating the G emission control signal as an output signal. A first transfer gate transfers the output signal of the shift register as the R emission control signal using the inverted external control signal and the external control signal. A second transfer gate grounds the R emission control signal using the inverted external control signal and the external control signal. A third transfer gate transfers the output signal of the shift register as the B emission control signal using the inverted external control signal and the external control signal. A fourth transfer gate grounds the B emission control signal using the inverted external control signal and the external control signal.

In yet another exemplary embodiment according to the present invention, an organic light emitting diode display includes a plurality of gate lines, a plurality of data lines, a plurality of emission control lines, a plurality of power supply lines, and a pixel portion including a plurality of pixels. Each said pixel is connected to a corresponding said gate line, a corresponding said data line, a corresponding said emission control line, and a corresponding said power supply line. A gate line driving circuit supplies the plurality of gate lines with a plurality of scan signals, a data line driving circuit sequentially supplies the plurality of data lines with R, G, B data signals, and an emission control signal generating circuit supplies the plurality of emission control lines with a plurality of emission control signals. Each said pixel includes R, G, B EL elements, which sequentially emit light based on the emission control signals per each of a plurality of subframes that form one frame. The emission control signal generating circuit includes a first signal generating device for generating one of the plurality of emission control signals as an output signal, and a plurality of second signal generating devices for generating other ones of the plurality of emission control signals using the output signal of the first signal generating device and an external control signal.

Each pixel may further include at least one switching transistor for switching the data signal, at least one driving transistor for providing the R, G, B EL elements with a driving current corresponding to the data signal, and a capacitor for storing the data signal, and a sequential control device for controlling sequential driving of the R, G, B EL elements.

The sequential control device may include first, second and third P-type thin film transistors, each said thin film transistor including a gate to which a corresponding said emission control signal is applied, a source connected to the driving device in common, and a drain connected to a corresponding one of the R, G, B EL elements. Alternatively, the sequential control device may include a first N-type thin film transistor, a first P-type thin film transistor and a second N-type thin film transistor, each said thin film transistor including a gate to which a corresponding said emission control signal is applied, a source connected to the driving device in common, and a drain connected to a corresponding one of the R, G, B EL elements.

In yet another exemplary embodiment according to the present invention, an organic light emitting diode display includes a plurality of gate lines, a plurality of data lines, a plurality of emission control lines, a plurality of power supply lines, and a pixel portion including a plurality of pixels, each said pixel being connected to a corresponding said gate line, a corresponding said data line, a corresponding said emission control line and a corresponding said power supply line. A gate line driving circuit supplies the plurality of gate lines with a plurality of scan signals, a data line driving circuit sequentially supplies the plurality of data lines with R, G, B data signals, and an emission control signal generating circuit supplies the plurality of emission control lines with R, G, B emission control signals. Each said pixel includes R, G, B EL elements, which sequentially emit light based on the R, G, B emission control signals per each of a plurality of subframes that form one frame. The emission control signal generating circuit includes a shift register for generating the G emission control signal as an output signal, and a first NAND gate for generating the R emission control signal using the output signal of the shift register and an external control signal as two inputs. An inverting gate inverts the external control signal to generate an inverted external control signal, and a second NAND gate generates the B emission control signal using the inverted external control signal and the output signal of the shift register as two inputs.

In yet another exemplary embodiment according to the present invention, an organic light emitting diode display includes a plurality of gate lines, a plurality of data lines, a plurality of emission control lines, a plurality of power supply lines, and a pixel portion including a plurality of pixels, each said pixel being connected to a corresponding said gate line, a corresponding said data line, a corresponding said emission control line and a corresponding said power supply line. A gate line driving circuit supplies the plurality of gate lines with a plurality of scan signals, a data line driving circuit sequentially supplies the plurality of data lines with R, G, B data signals, and an emission control signal generating circuit supplies the plurality of emission control lines with R, G, B emission control signals. Each said pixel includes R, G, B EL elements, which sequentially emit light based on the R, G, B emission control signals per each of a plurality of subframes that form one frame. The emission control signal generating circuit includes an inverting gate for inverting an external control signal to generate an inverted external control signal, and a shift register for generating the G emission control signal as an output signal. A first transfer gate transfers the output signal of the shift register as the R emission control signal using the inverted external control signal and the external control signal. A second transfer gate grounds the R emission control signal using the inverted external control signal and the external control signal. A third transfer gate transfers the output signal of the shift register as the B emission control signal using the inverted external control signal and the external control signal. A fourth transfer gate grounds the B emission control signal using the inverted external control signal and the external control signal.

In yet another exemplary embodiment according to the present invention, a method for driving an organic light emitting diode display including a plurality of pixels is provided. Each said pixel includes R, G, B EL elements, and emission of said elements is controlled by R, G, B emission control signals. The G emission control signal is generated during a first subframe among a plurality of subframes that form one frame to emit the G EL element, and the R emission control signal is generated using the G emission control signal during a second said subframe to emit the R EL element. The B emission control signal is generated using the G emission control signal during a third said subframe to emit the B EL element. The EL elements are maintained to be a black color during a rest subframe among the plurality of subframes.

In yet another exemplary embodiment of the present invention, a method for driving an organic light emitting diode display including a plurality of pixels is provided. Each said pixel includes R, G, B EL elements, and emission of each said element is controlled by R, G, B emission control signals. The G emission control signal is generated during a first subframe among a plurality of subframes that form one frame to emit the G EL element, and the R emission control signal is generated using the G emission control signal during a second said subframe to emit the R EL element. The B emission control signal is generated using the G emission control signal during a third said subframe to emit the B EL element. One of the R, G, B EL elements is emitted during a rest subframe among the plurality of subframes.

BRIEF DESCRIPTION OF THE DRAWINGS

The above and other features of the present invention will become more apparent to those of ordinary skill in the art with the description in detail of certain exemplary embodiments thereof with reference to the attached drawings in which.

DETAILED DESCRIPTION

Figure 1:
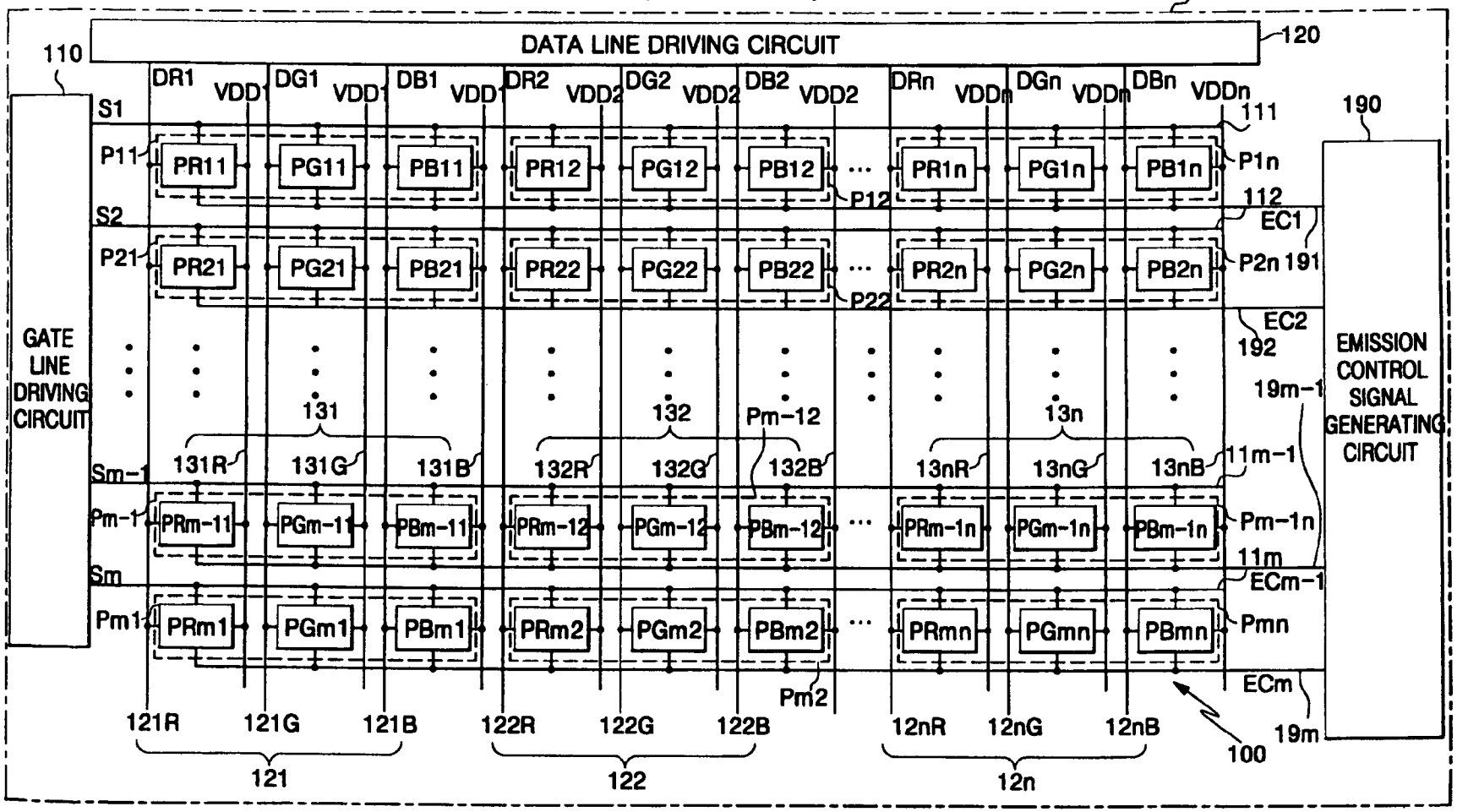
FIG. 1 (PRIOR ART)
FIG. 1 shows a configuration of a conventional organic light emitting diode (OLED) display.

The present invention will now be described more fully hereinafter with reference to the accompanying drawings, in which exemplary embodiments of the invention are shown. This present invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout the specification.

Figure 2:
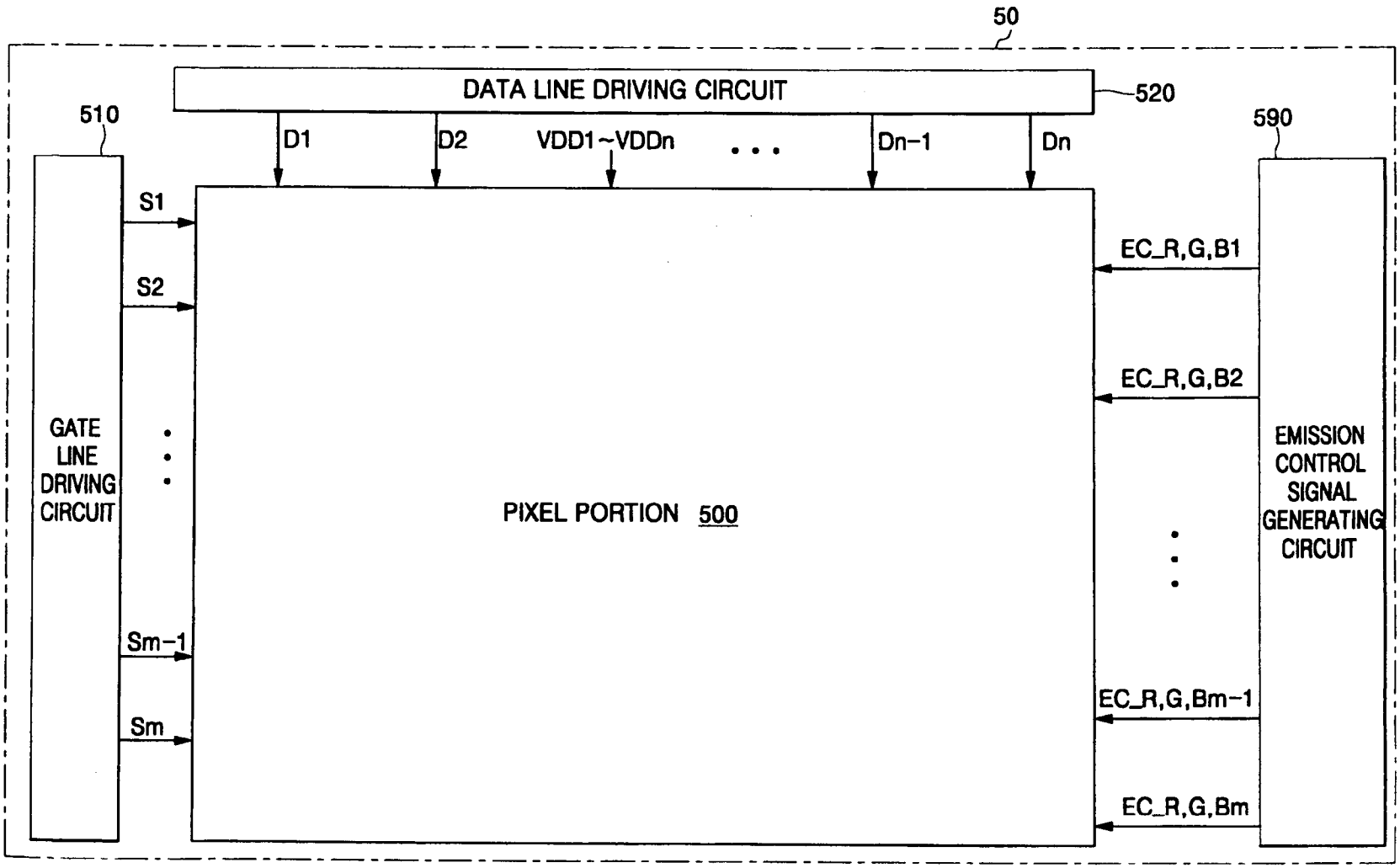
FIG. 2 is a block diagram of a sequential driving OLED display in accordance with an exemplary embodiment of the present invention.

Referring to FIG. 2, an OLED display 50 includes a pixel portion 500, a gate line driving circuit 510, a data line driving circuit 520, and an emission control signal generating circuit 590. The gate line driving circuit 510 sequentially generates scan signals S1-Sm to gate lines of the pixel portion 500 during one frame. The data line driving circuit 520 sequentially provides data lines of the pixel portion 500 with R, G, B data signals D1-Dn each time the scan signal is applied to the pixel portion during one frame. The emission control signal generating circuit 590 sequentially supplies emission control lines 591-59*m* (shown in FIG. 3) of the pixel portion 500 with emission control signals (EC_R, G, B1) to (EC_R, G, Bm) for controlling emission of the R, G, B EL elements each time the scan signal is applied to the pixel portion during one frame.

Figure 3:
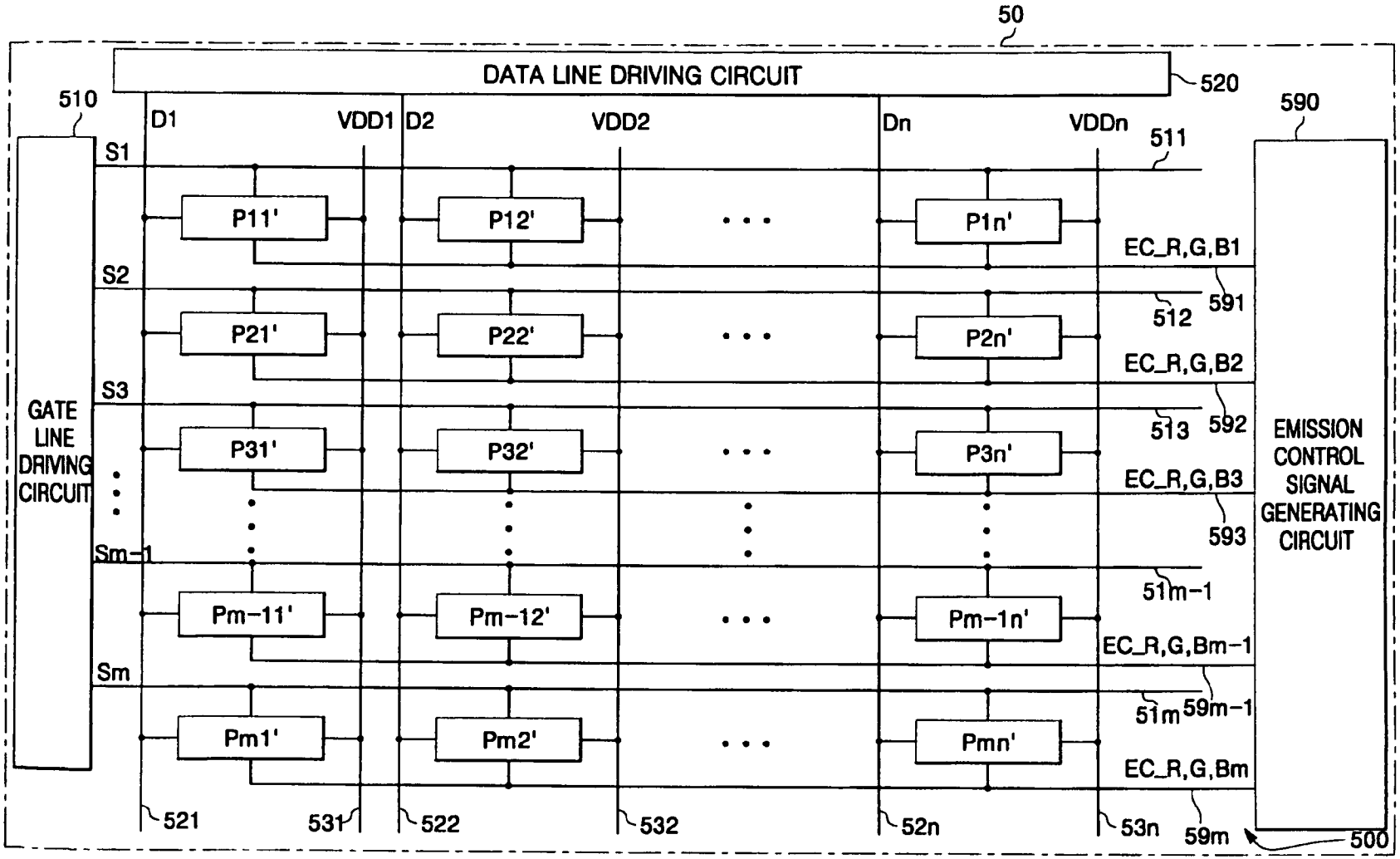
FIG. 3 is a block diagram of the OLED display of FIG. 2, which shows a pixel portion in more detail.

Referring to FIG. 3, the pixel portion 500 includes a plurality of gate lines 511-51*m* provided with scan signals S1-Sm, respectively, from the gate line driving circuit 510, a plurality of data lines 521-52*n* provided with data signals D1-Dn, respectively, from the data line driving circuit 520, a plurality of emission control lines 591-59*m* provided with emission control signals EC_R, G, B1 to EC_R, G, Bm, respectively, from the emission control signal generating circuit 590, and a plurality of power supply lines 531-53*n* for providing power supply voltages VDD1-VDDn, respectively.

The pixel portion 500 further includes a plurality of pixels P11'-Pmn' arranged in a matrix format, which are connected to the plurality of gate lines 511-51*m*, the plurality of data lines 521-52*n*, the plurality of emission control lines 591-59*m*, and the plurality of power supply lines 531-53*n*. Each of the pixels P11'-Pmn' is connected to a corresponding one of the plurality of gate lines 511-51*m*, a corresponding one of the plurality of data lines 521-52*n*, a corresponding one of the plurality of emission control lines 591-59*m*, and a corresponding one of the plurality of power supply lines 531-53*n*.

For example, the pixel P11' is connected to a first gate line 511 for providing a first scan signal S1 among the plurality of gate lines 511-51*m*, a first data line 521 for providing a first data signal D1 among the plurality of data lines 521-52*n*, a first emission control line 591 for providing a first emission control signal EC_R, G, B1 among the plurality of emission control lines 591-59*m*, and a first power supply line 531 among the plurality of power supply lines 531-53*n*.

Figure 4:
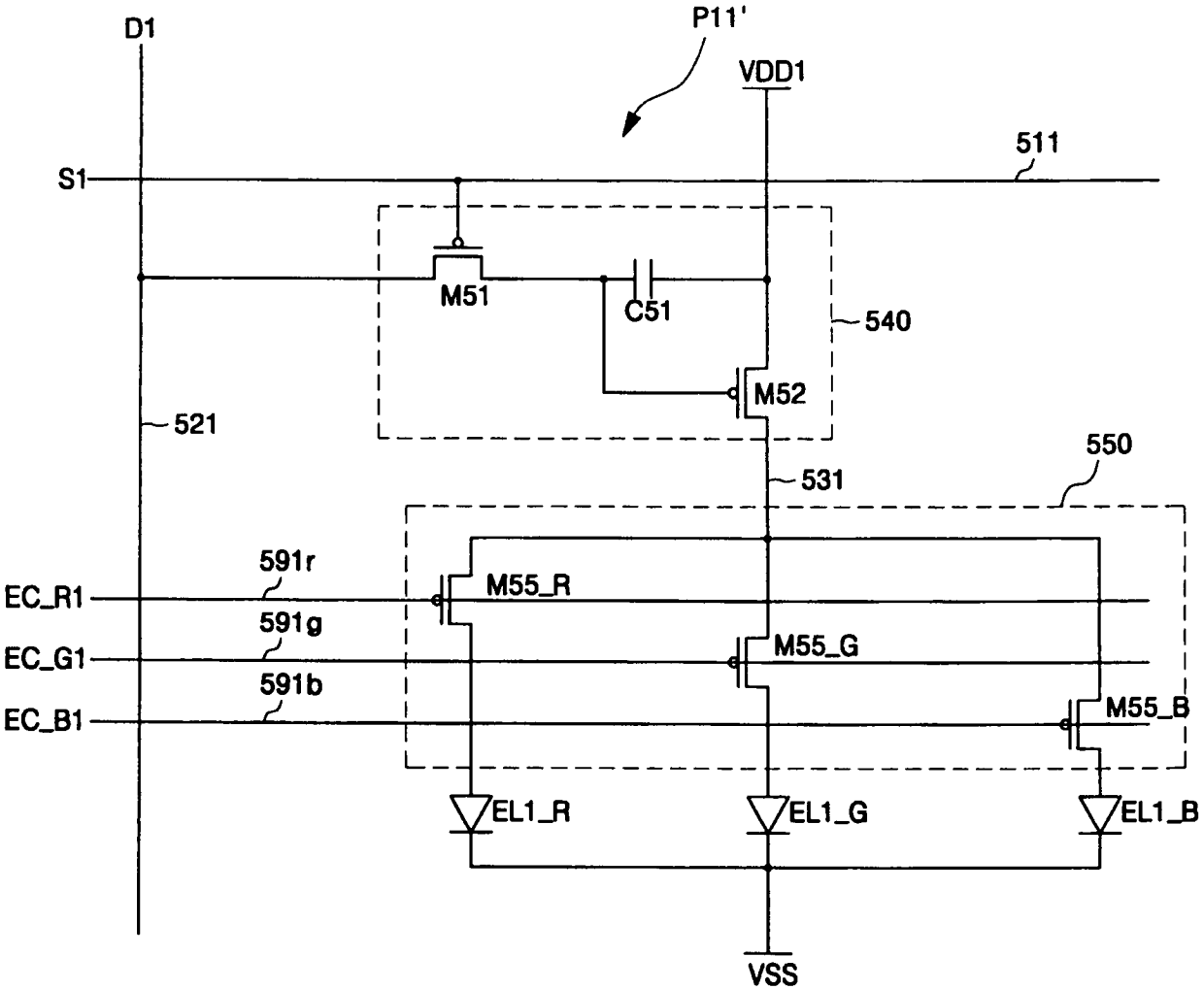
FIG. 4 shows a pixel circuit in the OLED display of FIG. 3.

FIG. 4 shows a pixel circuit for one pixel in a sequential driving OLED display in accordance with a first exemplary embodiment of the present invention, which corresponds to a case for the one pixel P11' among the plurality of pixels.

Referring to FIG. 4, the pixel P11' includes a gate line 511, a data line 521, three emission control lines 591*r*, 591*g*, 591*b*, a power supply line 531, and R, G, B EL elements EL1_R, EL1_G, EL1_B for emitting R, G, B colors, respectively, as display elements.

In addition, the pixel P11' includes an active element for driving the R, G, B EL elements EL1_R, EL1_G, EL1_B in a time-sharing and sequential manner. The active element has a driving device 540 for supplying the R, G, B EL elements EL1_R, EL1_G, EL1_B with a driving current corresponding to the R, G, B data signal D1 (DR1, DG1, DB1) each time the scan signal S1 is applied thereto, and a sequential control device 550 for sequentially providing the R, G, B EL elements EL1_R, EL1_G, EL1_B with a driving current corresponding to the R, G, B data signals (DR1, DG1, DB1) from the driving device 540 based on the emission control signals EC_R1, EC_G1, EC_B1.

The driving device 540 includes a switching transistor M51, a driving transistor M52, and a capacitor C51 connected between a gate and a source of the driving transistor M52. The scan signal S1 is applied to the gate of the switching transistor M51 from the gate line 511, and R, G, B data signals DR1, DG1, DB1 are sequentially applied to the source of the switching transistor M51 from the data line 521. In addition, the gate of the driving transistor M52 is connected to the drain of the switching transistor M51. Further, a power supply voltage VDD1 is applied to the source of the driving transistor M52 from the power supply line 531, and the drain of the driving transistor M52 is connected to the sequential control device 550.

The sequential control device 550 is connected between the drain of the driving transistor M52 of the driving device 540 and anodes of the R, G, B EL elements EL_R, EL1_G, EL1_B as display elements, and sequentially controls the driving of the R, G, B EL elements EL1_R, EL1_G, EL1_B based on the emission control signals EC_R1, EC_G1, EC_B1.

The sequential control device 550 has a first P-type thin film transistor M55_R for providing the R EL element (EL1_R) with the driving current corresponding to the R data signal from the driving transistor M52 in response to the first emission control signal EC_R1 applied to its gate, which is connected between the driving device 540 and the R EL element EL1_R.

The sequential control device 550 also includes a second P-type thin film transistor M55_G for providing the G EL element EL1_G with the driving current corresponding to the G data signal from the driving transistor M52 in response to the second emission control signal EC_G1 applied to its gate, which is connected between the driving means 540 and the G EL element EL1_G.

Further, the sequential control device 550 includes a third P-type thin film transistor M55-B for providing the B EL element EL1_B with the driving current corresponding to the B data signal from the driving transistor M52 in response to the third emission control signal EC_B1 applied to its gate, which is connected between the driving device 540 and the B EL element EL1_B.

The pixel circuit having the above-mentioned configuration allows R, G, B EL elements EL1_R, EL1_G, EL1_B to share the one driving device 540, so that these R, G, B EL elements EL1_R, EL1_G, EL1_B are sequentially driven in order to have the pixel P11' display a desired color by driving three. R, G, B EL elements EL1_R, EL1_G, EL1_B during one frame. In other words, one frame is divided into three sub frames, and R, G, B emission control signals corresponding to the sub frames are applied to the sequential control device 550 so as to perform sequential emission of the R, G, B EL elements EL1_R, EL1_G, EL1_B. As a result, the R, G, B EL elements EL1_R, EL1_G, EL1_B are driven in a time-sharing and sequential manner during one frame to thereby allow the pixel P11' to implement the desired color.

Figure 5:
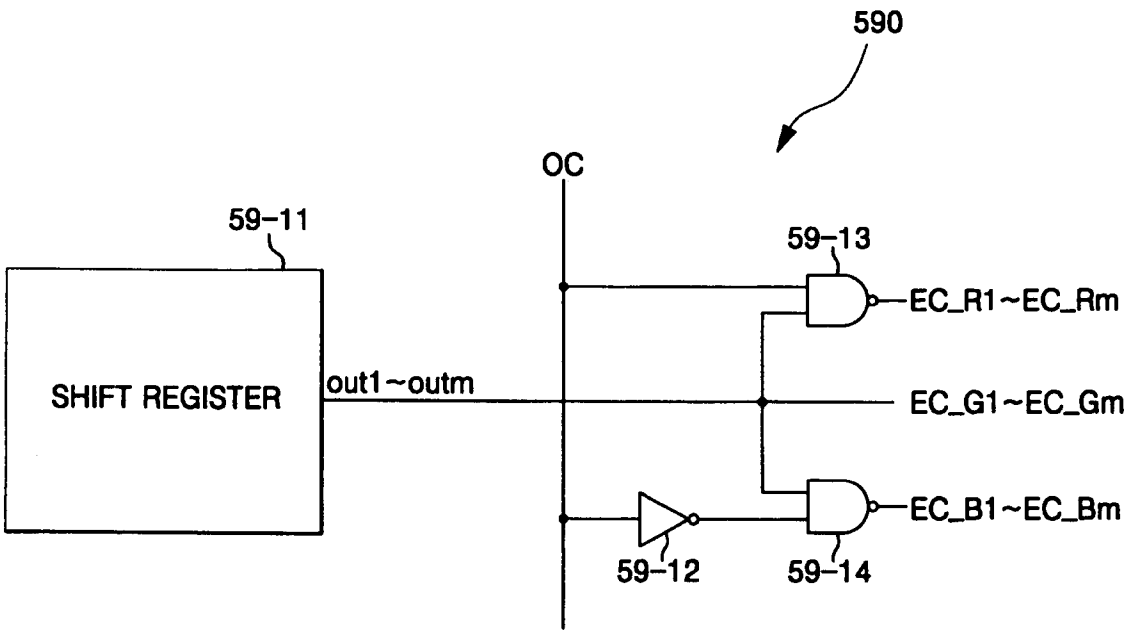
FIG. 5 shows an emission control signal generating circuit in the OLED display in accordance with a first exemplary embodiment of the present invention.

Referring to FIG. 5, the emission control signal generating circuit 590 includes a shift register 59-11 for generating the emission control signals is EC_G1-EC_Gm for controlling the emission of the G EL elements. The emission control signal generating circuit 590 also includes a first NAND gate 59-13 that uses the output control signal OC and the output signal of the shift register 59-11 (out1-outm) as two inputs to generate the emission control signals EC_R1-EC_Rm for controlling the emission of the R EL elements. Further, the emission control signal generating circuit 590 includes an inverter 59-12 for inverting the output control signal OC, and a second NAND gate 59-14 that uses the output signal of the shift register 59-11 (out1-outm) and the output of the inverter 59-12 as two inputs to generate the emission control signals EC_B1-EC_Bm for controlling the emission of the B EL elements.

Figure 6:
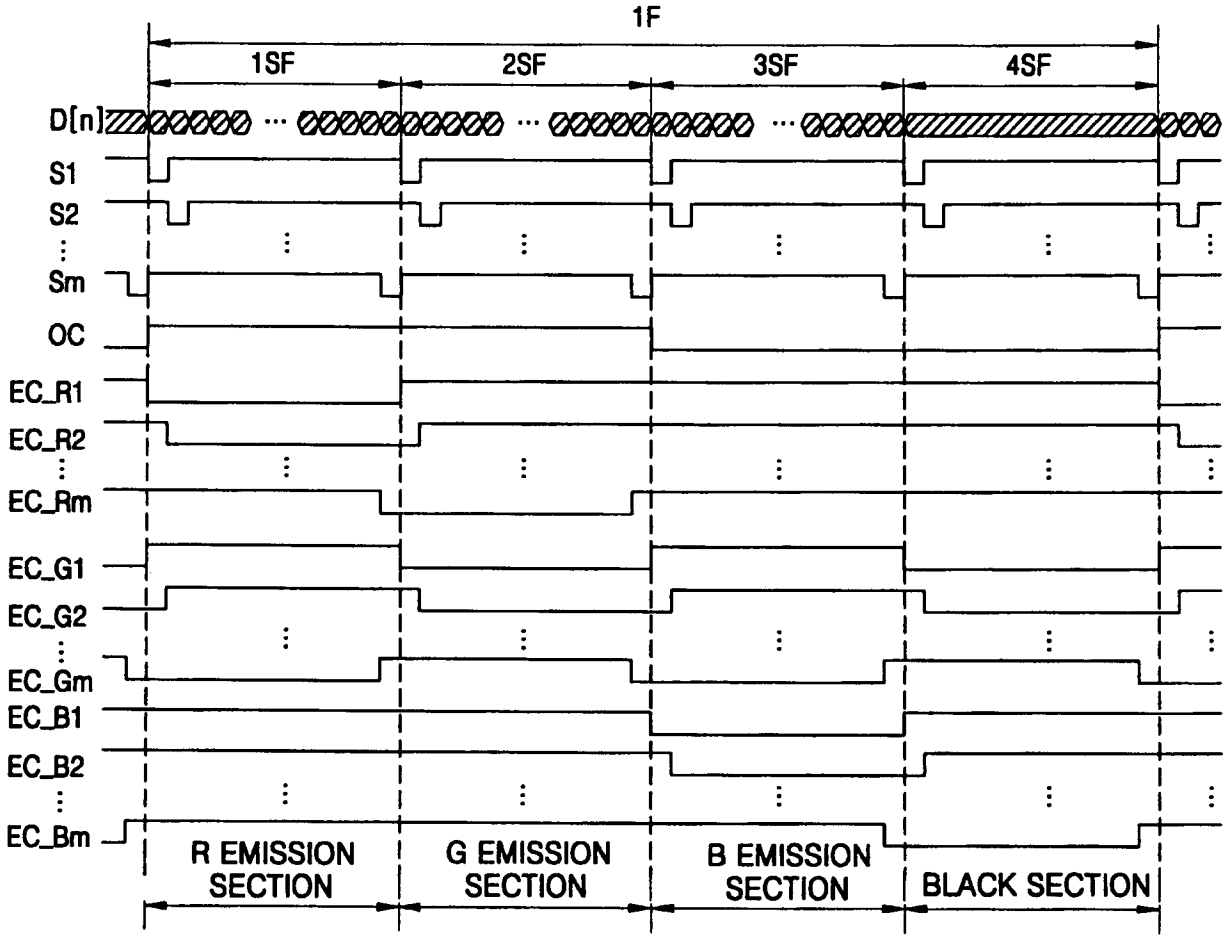
FIG. 6 shows operating waveforms of an OLED display using the emission control signal generating circuit of FIG. 5.

Waveform having the same duty ratio as the G emission control signals EC_G1-EC_Gm as shown in FIG. 6 for controlling the G EL elements is supplied to the shift register 59-11 as an input signal, and the shift register 59-11 delays the input signal for a predetermined time to generate the G emission control signals EC_G1-EC_Gm.

Hereinafter, a method for driving the OLED display having the above-mentioned configuration in accordance with the present invention will be described with reference to FIG. 6.

In exemplary embodiments of the present invention, one frame is divided into four subframes, and a scan signal is applied to the respective gate lines from the gate line driving circuit 510 during each subframe, so that 4*m* scan signals are applied thereto during one frame. When the scan signal S1 is applied to the first gate line 511 during the first subframe 1SF, the switching transistor M51 is turned on to allow the R data signal DR1 to be applied from the data line 521 to the driving transistor M52.

In this case, the R emission control signal EC_R1 is generated by the NAND gate 59-13 using the output control signal OC and the G emission control signal EC_G1 as two inputs in the emission control signal generating circuit 590. As a result, when the emission control signal EC_R1 is applied to the sequential control device 550 to control the R EL element EL_R of each of the pixels P11'-P1*n*' connected to the first gate line 511 through the emission control line 591*r*, the thin film transistor M55_R is turned on to allow the driving current corresponding to the R data signals DR1-DRn to flow, respectively, through the R EL elements of the pixels to be driven.

When the second scan signal S1 is applied to the first gate line 511 during the second subframe 2SF of the first frame 1F, the G data signals DG1-DGn are applied to the driving transistors M52 of the pixels P11'-P1*n*' through the data line 521-52*n*, respectively. In this case, the G emission control signal EC_G1 generated by the shift register 59-11 in the emission control signal generating circuit 590 is provided through the emission control line 591*g*.

As a result, when the emission control signal EC_G1 is applied to the sequential control device 550 to control the G EL element EL_G of each of the pixels P11'-P1*n*' connected to the first gate line 511, the thin film transistors M55_G in the pixels are turned on to allow the driving current corresponding to the G data signals DG1-DGn to flow, respectively, through the G EL elements to be driven.

When the third scan signal S1 is applied to the first gate line 511 during the third subframe 3SF of the first frame 1F, the B data signals DB1-DBn are applied to the driving transistors M52 of the pixels P11'-P1*n*' through the data line 521-52*n*, respectively. In this case, the B emission control signal EC_B1 is generated in the emission control signal generating circuit 590 by the NAND gate 59-14 using its two inputs of the output control signal OC and the output signal out1 of the shift register 59-11 to the emission control line 591*b*.

As a result, when the emission control signal EC_B1 is applied to the sequential control device 550 to control the B EL element EL_B in each of the pixels P11'-Pin' connected to the first gate line 511, the thin film transistors M55_B of the pixels are turned on to allow the driving current corresponding to the B data signals DB1-DBn to flow, respectively, through the B EL elements to be driven.

During the fourth subframe 4SF of the first frame, in response to the emission control signals EC_R1 and EC_B1 generated by the emission control signal generating circuit 590, the R and B EL elements are turned off, and a driving current corresponding to black data flows through the G EL element to thereby display a black color during the fourth subframe.

When the above-mentioned operation is repeated per each subframe of one frame to apply the scan signal to the $m^{th}$ gate line 51*m*, the R, G, B data signals (DR1-DRn), (DG1-DGn), (DB1-DBn) are sequentially applied to the data lines 521-52*n*, and the emission control signals (EC_Rm, EC_Gm, EC_Bm) are sequentially generated by the emission control signal generating circuit 590 to the sequential control device 550, which sequentially controls the R, G, B EL elements of the pixel Pm1'-Pmn' connected to the $m^{th}$ gate line 51*m* through the emission control lines 59*mr*, 59*mg*, 59*mb*. As a result, the thin film transistors M55_R, M55_G, M55_B are sequentially turned on to thereby allow driving currents corresponding to the R, G, B data signals DR1-DRn, DG1-DGn, DB1-DBn to sequentially flow through the R, G, B EL elements to be driven.

Therefore, one frame is divided into four subframes, and the R, G, B EL elements are sequentially controlled by the emission control signals generated from the emission control signal generating circuit 590 during the first to third subframes, and are controlled to have a black color in the fourth subframe in the described embodiment of the present invention.

As such, whenever the scan signals S1-Sm are applied per each subframe of the one frame, the data signals DR1-DRn, DG1-DGn, DB1-DBn are sequentially applied to the data lines, respectively, so that the R, G, B EL elements EL_R, EL_G, EL_B of the pixel P11'-Pmn' are sequentially driven in a time-sharing manner. In this case, the R, G, B EL elements are sequentially driven, however, such sequential driving takes place within a very short time period, so that people may perceive these R, G, B EL elements as being simultaneously driven to allow the image therefrom to be naturally displayed.

The pixel circuit of the present invention allows R, G, B EL elements EL1_R, EL1_G, EL1_B of the pixel P11 to share one driving device 540, which leads to simplify the circuit configuration. In addition, three emission control signals for R, G, B are generated from one shift register to thereby reduce the circuit area.

The output control signal OC is supplied from an external source to the emission control signal generating circuit 590, and controls the R, G, B emission control signals to be output from the emission control signal generating circuit.

In accordance with a method for driving the OLED display of the present invention, as shown in FIG. 6, one frame is divided into four subframes, and R, G, B EL elements are sequentially driven by the R, G, B emission control signals generated from the emission control signal generating circuit 590 per each of the three subframes, and the R and B EL elements are put in a non-emission state and the G EL element to be in a black color state by the R, G, B emission control signals generated from the emission control signal generating circuit during the rest subframe.

Figure 7:
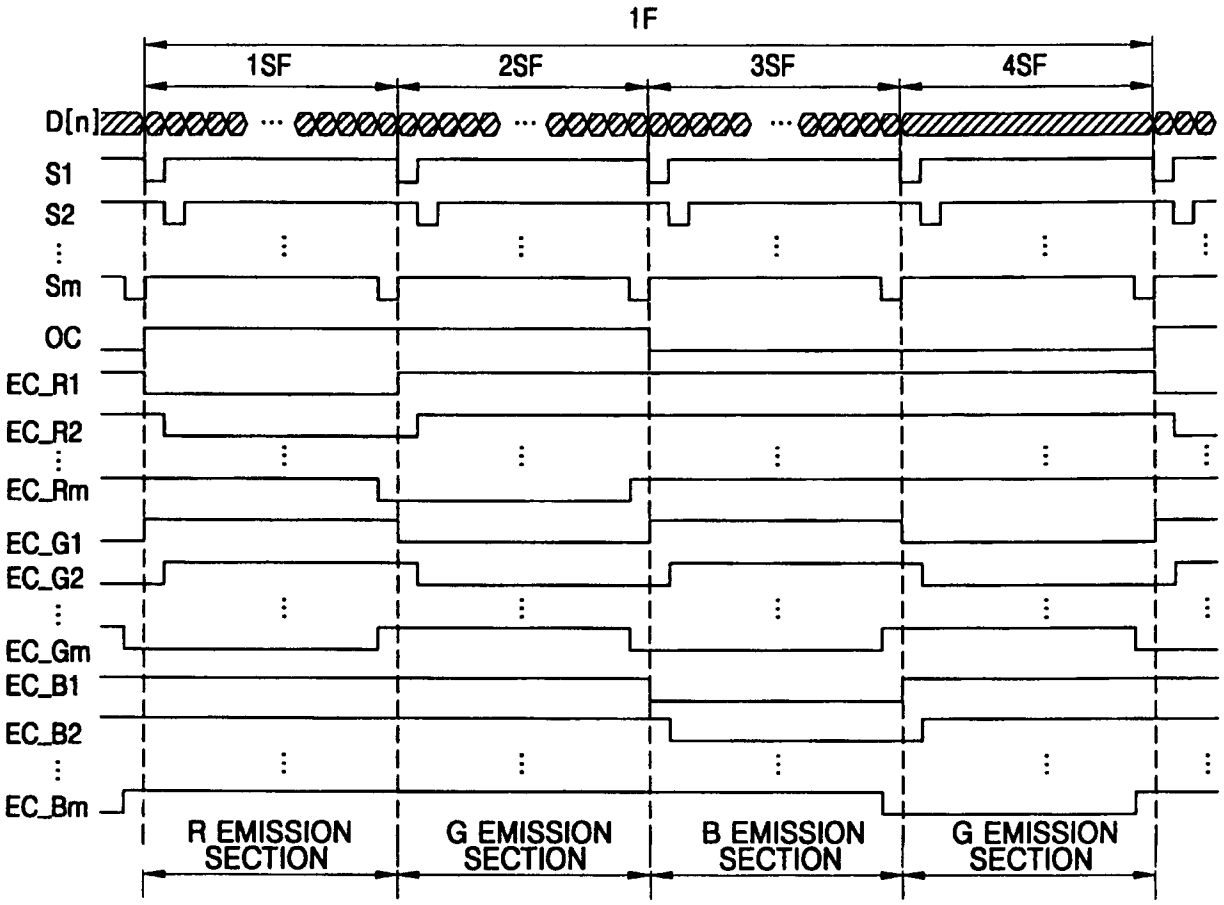
FIG. 7 shows other operating waveforms of an OLED display using the emission control signal generating circuit of FIG. 5.

In accordance with another method for driving the OLED display of the present invention, as shown in FIG. 7, one frame is divided into four subframes, and R, G, B EL elements are sequentially driven by the R, G, B emission control signals generated from the emission control signal generating circuit 590 per each of the three subframes, and the emission control signal generating circuit 590 drives again one of the R, G, B EL elements, for example, the G EL element during the rest subframe. As such, one EL element, for example, the G EL element having a relatively high driving current among the R, G, B EL elements is driven by half of the driving current in the second subframe and by half in the fourth subframe, so that it is driven twice, which reduces the current amount flowing through the G EL element during one subframe to thereby reduce the power consumption and lengthen the lifetime thereof.

Figure 8:
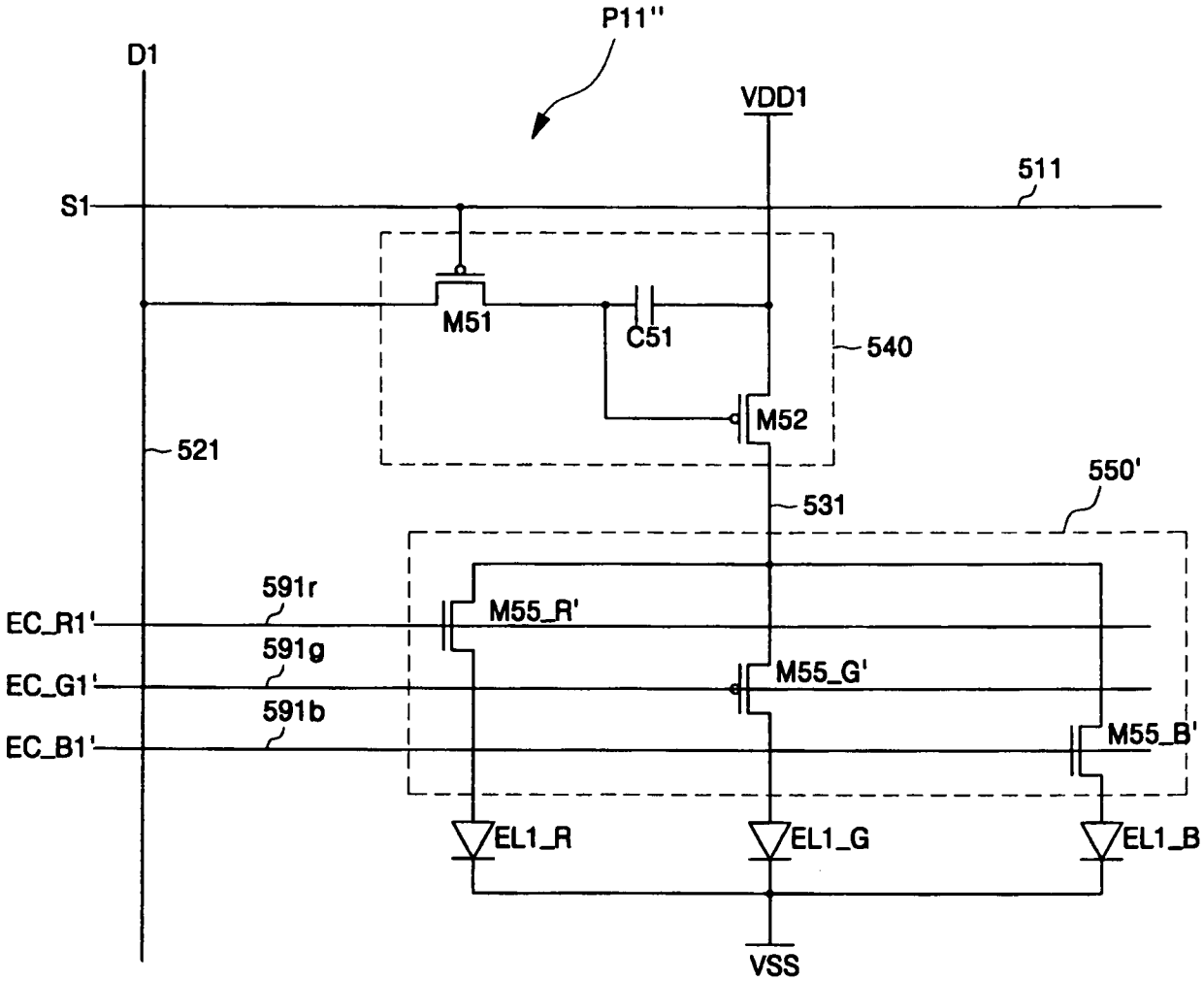
FIG. 8 shows a pixel circuit of an OLED display in accordance with a second exemplary embodiment of the present invention.

FIG. 8 shows a pixel circuit of a sequential driving OLED display in accordance with a second exemplary embodiment of the present invention, which corresponds to a case for one pixel P11" among the plurality of pixels. The pixel P11" of FIG. 8, for example, may be used in the OLED display that has substantially the same configuration as the OLED display 50 of FIGS. 2 and 3 in a pixel portion which is substantially the same as the pixel portion 500.

Referring to FIG. 8, the configuration of the pixel circuit in accordance with the second exemplary embodiment of the present invention is almost the same as the pixel circuit of the first embodiment. A difference therebetween is as follows. A sequential control device 550 includes a first N-type thin film transistor M55_R' connected between a driving device 540 and the R EL element EL1_R and provides a driving current corresponding to the R data signal from the driving transistor M52 to the R EL element EL1_R in response to the first emission control signal EC_R1' applied to its gate. In addition, a second P-type thin film transistor M55_G' connected between the driving device 540 and the G EL element EL1_G provides a driving current corresponding to the G data signal from the driving transistor M52 to the G EL element EL1_G in response to the second emission control signal EC_G1' applied to its gate. Further, a third N-type thin film transistor M55_B' connected between the driving device 540 and the B EL element EL1_B provides a driving current corresponding to the B data signal from the driving transistor M52 to the B EL element EL1_B in response to the third emission control signal EC_B1' applied to its gate.

Figure 9:
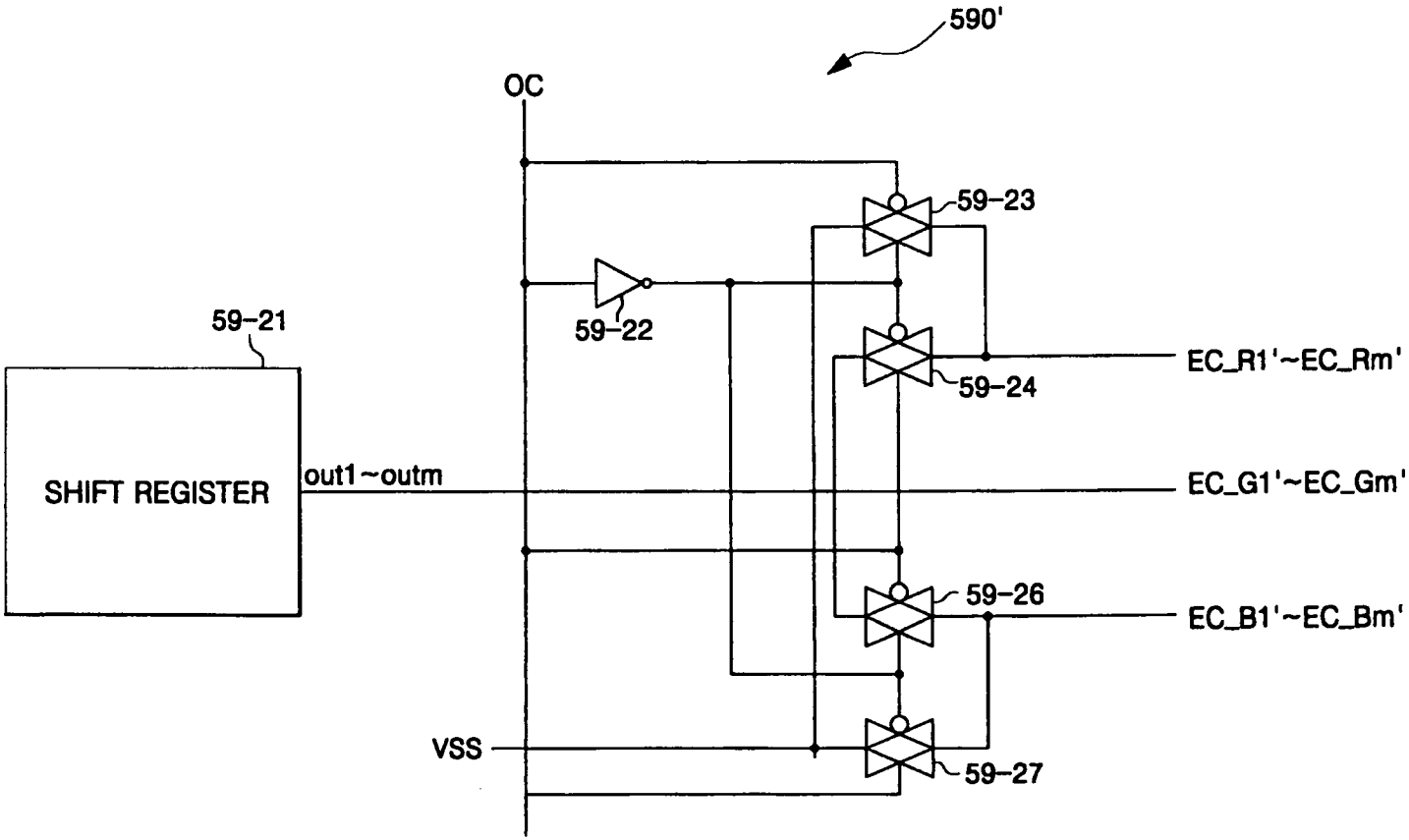
FIG. 9 shows an emission control signal generating circuit of an OLED display in accordance with a second exemplary embodiment of the present invention.

FIG. 9 shows an emission control signal generating circuit 590' of an OLED display in accordance with a second exemplary embodiment of the present invention. The emission control signal generating circuit 590' of FIG. 9, for example, may be used in an OLED display which is substantially the same as the OLED display 50 of FIGS. 2 and 3.

Referring to FIG. 9, the emission control signal generating circuit in accordance with the second exemplary embodiment includes a shift register 59-21 that generates emission control signals EC_G1'-EC_Gm' for controlling the emission of the G EL elements, and an inverting gate 59-22 for inverting the output control signal OC.

In addition, the emission control signal generating circuit 590' further includes a first transfer gate 59-24 for transferring the output signals out1-outm (i.e., EC_G1'-EC_Gm') of the shift register 59-21 in response to the output signal of the inverting gate 59-22 and the external control signal as the R emission control signals EC_R1'-EC_Rm', and a second transfer gate 59-23 for grounding the R emission control signals EC_R1'-EC_Rm' in response to the output signal of the inverting gate 59-22 and the output control signal OC.

The emission control signal generating circuit 590' further includes a third transfer gate 59-26 for transferring the output signals out1-outm (i.e., EC_G1'-EC_Gm') of the shift register 59-21 in response to the output signal of the inverting gate 59-22 and the output control signal OC as the B emission control signals EC_B1'-EC_Bm', and a fourth transfer gate 59-27 for grounding the B emission control signals EC_B1-EC_Bm in response to the output signal of the inverting gate 59-22 and the output control signal OC.

Waveform having the same duty ratio as the G emission control signals EC_G1'-EC_Gm' as shown in FIG. 9 for controlling the G EL elements is supplied to the shift register 59-21 as an input signal, and the shift register 59-21 delays the input signal for a predetermined time to generate the G emission control signals EC_G1'-EC_Gm'. The ground voltage Vss may be separately provided, or it may be the ground voltage used for the shift register 59-21 or the inverting gate 59-22

The emission control circuit of the OLED display in accordance with the second exemplary embodiment of the present invention places the emission control signal of the corresponding EL element in a ground level when the corresponding EL element is in a non-emission state, however, it may place the emission control signal of the EL element of the non-emission state in a level of power supply voltage (VDD) when all of the transistors in the sequential control device are P-type thin film transistors as shown in the pixel circuit of FIG. 4.

Hereinafter, a method for driving the OLED display having the above-mentioned emission control signal generating circuit in exemplary embodiments of the present invention will be described with reference to FIG. 10.

One frame is divided into four subframes in exemplary embodiments of the present invention, and scan signals are applied from the gate line driving circuit 510 to the gate lines during each subframe, so that 4*m* scan signals are applied thereto during one frame. When the scan signal S1 is applied to the first gate line 511 during the first subframe, the switching transistor M51 is turned on to allow the R data signal DR1 to be supplied from the data line 521 to the driving transistor M52.

In this case, the R emission control signal EC_R1' is generated by the emission control signal generating circuit 590' through the transfer gate 59-24 having the output control signal OC and the output control signal OC inverted from the inverting gate 59-22 as its control signals. As a result, when the emission control signal EC_R1' is applied to the sequential control device 550' to control the R EL element EL_R in each of the pixels P11'-P1*n*' connected to the first gate line 511 through the emission control line 591*r*, the thin film transistor M55_R' is turned on to allow the driving current corresponding to the R data signals DR1-DRn to flow, respectively, through the R EL elements to be driven. In this case, since the ground voltage Vss is applied through the transfer gate 59-27 as the B emission control signals EC_B1-EC_Bm, the B EL elements are not driven.

When the second scan signal S1 is applied to the first gate line 511 during the second subframe 2SF of the first frame 1F, the G data signals DG1-DGn are applied to the driving transistors M52 of the pixels P11'-P1*n*' through the data lines 521-52*n*, respectively. In this case, the emission control signal generating circuit 590' generates the G emission control signal EC_G1' from the shift register 59-21, which is provided through the emission control line 591*g*.

As such, when the emission control signal EC_G1' is applied to the sequential control device 550' to control the G EL elements EL_G of the pixels P11'-Pin' connected to the first gate line 511, the thin film transistors M55_G' of the pixels P11'-P1*n*' are turned on to allow the driving current corresponding to the G data signals DG1-DGn to flow, respectively, through the G EL elements to be driven.

When the third scan signal S1 is applied to the first gate line 511 during the third subframe 3SF of the first frame 1F, the B data signals DB1-DBn are applied to the driving transistors M52 through the data lines 521-52*n*, respectively. In this case, the emission control signal generating circuit 590' generates the B emission control signal EC_B1' to the emission control line 591*b* through the transfer gate 59-26 in response to the output control signal OC and the output control signal OC inverted by the inverter 59-22. Since the ground voltage Vss is supplied to the transfer gate 59-23 as the R emission control signals EC_R1'-EC_Rm', the R EL element is not driven.

As such, when the emission control signal EC_B1' is applied to the sequential control device 550' to control the B EL elements EL_B of the pixels P11'-P1*n*' connected to the first gate line 511, the thin film transistors M55_B' in the pixels are turned on to allow the driving current corresponding to the B data signals DB1-DBn to flow, respectively, through the B EL elements to be driven.

During the fourth subframe 4SF of the first frame, the emission control signals generated from the sequential control device 550' turn off the R and B EL elements, and have the driving current corresponding to black data to flow through the G EL element, which leads to have the black color displayed in the fourth subframe.

When the above-mentioned operation is repeated per each subframe of one frame to apply the scan signal to the $m^{th}$ gate line 51*m*, the R, G, B data signals (DR1-DRn), (DG1-DGn), (DB1-DBn) are sequentially applied to the data lines 521-52*n*, and the emission control signals (EC_Rm', EC_Gm', EC_Bm') are sequentially generated by the emission control signal generating circuit 590' to the sequential control device 550', which sequentially controls the R, G, B EL elements of the pixels Pm1'-Pmn' connected to the $m^{th}$ gate line 51*m* through the emission control lines 59*mr*, 59*mg*, 59*mb*. As a result, the thin film transistors M55_R', M55_G', M55_B' are sequentially turned on to thereby allow driving currents corresponding to the R, G, B data signals DR1-DRn, DG1-DGn, DB1-DBn to sequentially flow, respectively, through the R, G, B EL elements to be driven.

As such, whenever the scan signals S1-Sm are applied during each subframe of one frame, the data signals DR1-DRn, DG1-DGn, DB1-DBn are sequentially applied to the data lines, respectively, so that the R, G, B EL elements EL_R, EL_G, EL_B of the pixel P11'-Pmn' are sequentially driven in a time-sharing manner.

The output control signal OC is supplied from an external source to the emission control signal generating circuit, and controls the R, G, B emission control signals to be output from the emission control signal generating circuit.

Figure 10:
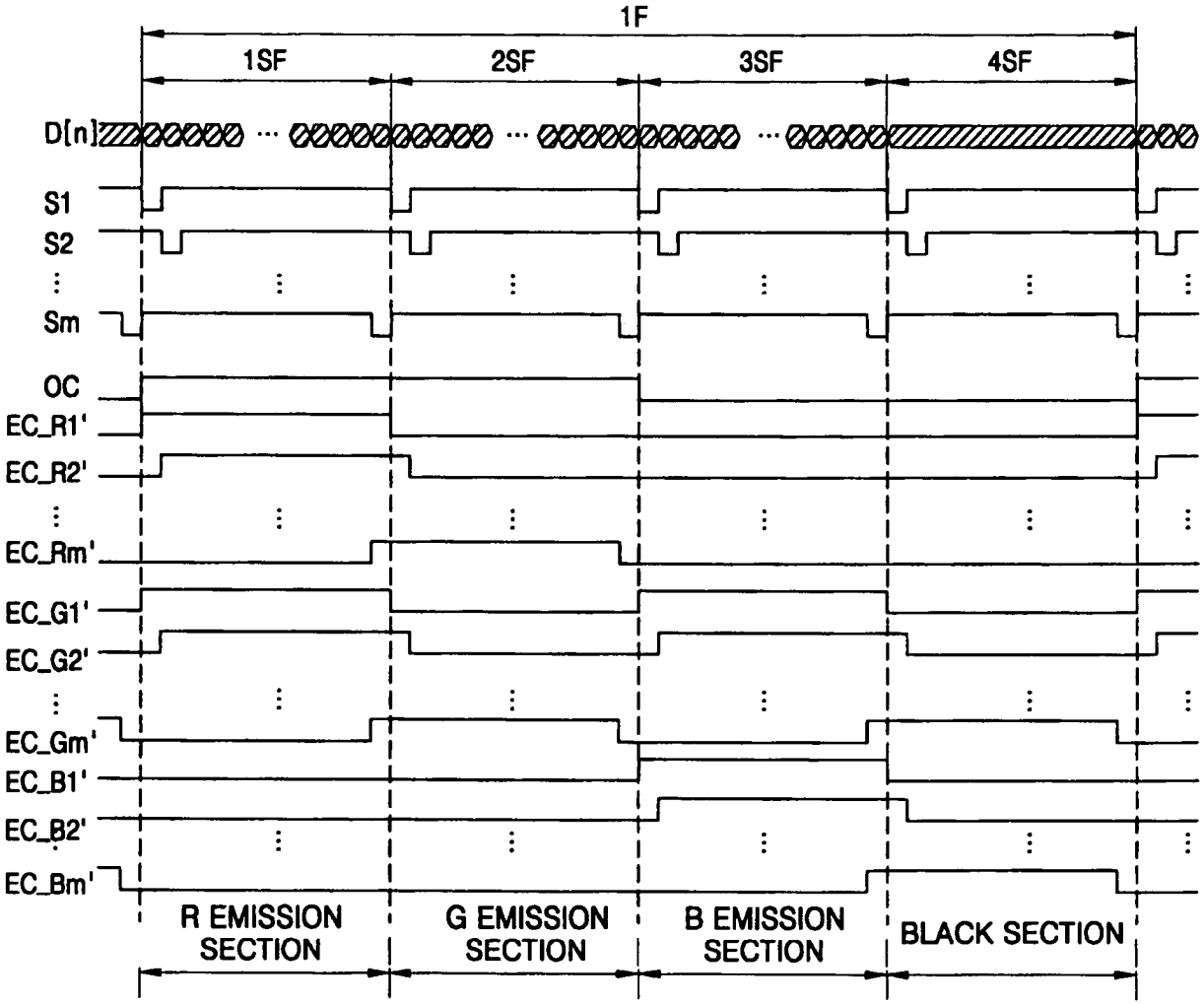
FIG. 10 shows operating waveforms of an OLED display using the emission control signal generating circuit of FIG. 9.

In accordance with a method for driving the OLED display in accordance with the second exemplary embodiment of the present invention, as shown in FIG. 10, one frame is divided into four subframes, and the R, G, B EL elements are sequentially driven by the R, G, B emission control signals generated from the emission control signal generating circuit 590' per each of three subframes, and are driven by the R, G, B emission control signals to allow them to be in black color state during the rest subframe.

In accordance with another method for driving the OLED display of the second exemplary embodiment of the present invention, as shown in FIG. 7, one frame is divided into four subframes, and the R, G, B EL elements may be sequentially driven by the R, G, B emission control signals generated from the emission control signal generating circuit 590 per each of three subframes, and by the emission control signal generating circuit 590, the G EL element of the R, G, B EL elements may be driven again during the rest subframe.

In accordance with the method for driving the OLED display of the present invention, the R, G, B emission control signals may be controlled to have a duty ratio of 50% to thereby reduce flicker and may be readily adjusted to thereby adjust white balance.

The emission control signal generating circuit of the present invention is applied to the OLED display which is sequentially driven per each subframe, however, it may be applied to the OLED display for driving the R, G, B EL elements using a plurality of emission control signals.

In the OLED display in accordance with the above-mentioned exemplary embodiments, the emission control signal generating circuit is formed to combine one shift register and a plurality of logic gates, which results in a simplified circuit configuration and a reduced circuit area. In addition, the duty ratio of the emission control signal may be adjusted to reduce the flicker and to adjust the white balance.

Further, the R, G, B EL elements share thin film transistors and a switching thin film transistor to be driven in a time-sharing manner, which implements the fine pitch, and the number of elements and interconnection lines may be reduced to improve the aperture ratio and the yield. In addition, RC delay and IR drop may be reduced.

While the present invention has been described with reference to certain exemplary embodiments, it should be understood that the disclosure has been made with the purpose of illustrating the invention by way of examples and is not intended to limit the scope of the invention. One skilled in the art would recognize that the described embodiments may be amended in various different ways without departing from the spirit or scope of the present invention. The scope of the present invention is indicated by the appended claims, and all changes that come within the meaning and range of equivalents thereof are intended to be embraced therein.

What is claimed is:

1. An emission control signal generating circuit of a flat panel display comprising a plurality of pixels, each said pixel including a plurality of electroluminescent elements, a driving transistor, and a plurality of emission control transistors respectively connected to a corresponding one of the plurality of electroluminescent elements and the driving transistor to form separate current paths between the corresponding one of the plurality of electroluminescent elements and the driving transistor, such that a first current path is formed by the driving transistor, a first emission control transistor, and the electroluminescent element corresponding to the first emission control transistor, while a second separate current path is formed by the driving transistor, a second emission control transistor, and the electroluminescent element corresponding to the second emission control transistor, the emission control transistors being controlled by a plurality of emission control signals, the circuit comprising:

a first signal generating device for generating one of the plurality of emission control signals as an output signal and for transmitting said output signal directly to at least one of the pixels for controlling a corresponding one of the emission control transistors of the at least one of the pixels; and a plurality of second signal generating devices for generating other ones of the plurality of emission control signals using the output signal of the first signal generating device and an external control signal, and for transmitting said other ones of the plurality of emission control signals to the at least one of the pixels for controlling other corresponding ones of the emission control transistors of the at least one of the pixels, wherein the external control signal used by each of the plurality of second signal generating devices corresponding to a same first signal generating device is the same signal.

2. The circuit as claimed in claim 1, wherein the first signal generating device for generating said one of the plurality of emission control signals includes a shift register.

3. The circuit as claimed in claim 1, wherein one of the plurality of second signal generating devices includes a NAND gate having the external control signal and the output signal of the first signal generating device as two inputs, and another one of the plurality of second signal generating devices includes a NAND gate having an inverted signal of the external control signal and the output signal of the first signal generating device as two inputs.

4. The circuit as claimed in claim 1, wherein the external control signal is an output control signal that controls the output of the emission control signal generating circuit, which is supplied from an external source.

5. The circuit as claimed in claim 1, wherein the plurality of electroluminescent elements are configured to be sequentially driven per each of a plurality of subframes that form one frame, and are in a black color state during one of the plurality of subframes.

6. The circuit as claimed in claim 1, wherein the plurality of electroluminescent elements are configured to be sequentially driven per each of a plurality of subframes that form one frame, and one of the plurality of electroluminescent elements is configured to be driven again during one of the plurality of subframes.

7. An emission control signal generating circuit of an organic light emitting diode display comprising a plurality of pixels, each said pixel including red, green, and blue electroluminescent elements, emission of said elements being controlled by red, green, and blue emission control signals, the circuit comprising:

a shift register for generating the green emission control signal as an output signal and for transmitting said output signal directly to at least one of the pixels for controlling emission of the green electroluminescent element of the at least one of the pixels;

a first NAND gate for generating the red emission control signal using the output signal of the shift register and an external control signal as two inputs and for transmitting said red emission control signal to the at least one of the pixels for controlling emission of the red electroluminescent element of the at least one of the pixels;

an inverting gate for inverting the external control signal to generate an inverted external control signal; and a second NAND gate for generating the blue emission control signal using the inverted external control signal and the output signal of the shift register as two inputs and for transmitting said blue emission control signal to the at least one of the pixels for controlling emission of the blue electroluminescent element of the at least one of the pixels.

8. The circuit as claimed in claim 7, wherein the red, green, and blue electroluminescent elements are configured to be sequentially driven per each of a plurality of subframes that form one frame, and the red, green, and blue electroluminescent elements are in a black color state or one of the red, green, or blue electroluminescent elements is configured to be driven again during one of the plurality of subframes.

9. An organic light emitting diode display, comprising:

a plurality of gate lines, a plurality of data lines, a plurality of emission control lines, and a plurality of power supply lines;

a pixel portion including a plurality of pixels, each said pixel being connected to a corresponding said gate line, a corresponding said data line, at least one corresponding said emission control line and a corresponding said power supply line;

a gate line driving circuit for supplying the plurality of gate lines with a plurality of scan signals;

a data line driving circuit for sequentially supplying the plurality of data lines with red, green, and blue data signals; and an emission control signal generating circuit for supplying the plurality of emission control lines with a plurality of emission control signals, wherein each said pixel includes red, green, and blue electroluminescent elements, a driving transistor, and emission control transistors respectively connected to a corresponding one of the red, green, and blue electroluminescent elements and the driving transistor to form separate current paths between the corresponding one of the red, green, and blue electroluminescent elements and the driving transistor, such that a first current path is formed by the driving transistor, a first emission control transistor, and the red electroluminescent element, a separate second current path is formed by the driving transistor, a second emission control transistor, and the green electroluminescent element, and a separate third current path is formed by the driving transistor, a third emission control transistor, and the blue electroluminescent element, the electroluminescent elements being configured to sequentially emit light based on the emission control signals per each of a plurality of subframes that form one frame, and wherein the emission control signal generating circuit includes:

a first signal generating device for generating one of the plurality of emission control signals as an output signal and for transmitting said output signal directly to at least one of the pixels for controlling a corresponding one of the emission control transistors of the at least one of the pixels; and a plurality of second signal generating devices for generating other ones of the plurality of emission control signals using the output signal of the first signal generating device and an external control signal, and for transmitting said other ones of the plurality of emission control signals to the at least one of the pixels for controlling other corresponding ones of the emission control transistors of the at least one of the pixels, wherein the external control signal used by each of the plurality of second signal generating devices corresponding to a same first signal generating device is the same signal.

10. The organic light emitting diode display as claimed in claim 9, wherein the first signal generating device includes a shift register.

11. The organic light emitting diode display as claimed in claim 9, wherein one of the plurality of second signal generating devices includes a NAND gate having the external control signal and the output signal of the first signal generating device as two inputs, and another one of the plurality of second signal generating devices includes a NAND gate having an inverted signal of the external control signal and the output signal of the first signal generating device as two inputs.

12. The organic light emitting diode display as claimed in claim 9, wherein the red, green, and blue electroluminescent elements are configured to be sequentially driven per each of a plurality of subframes that form one frame, and the red, green, and blue electroluminescent elements are in a black color or one of the red, green, or blue electroluminescent elements is configured to be driven again during one of the plurality of subframes.

13. An organic light emitting diode display, comprising:

a plurality of gate lines, a plurality of data lines, a plurality of emission control lines, and a plurality of power supply lines;

a pixel portion including a plurality of pixels, each said pixel being connected to a corresponding said gate line, a corresponding said data line, at least one corresponding said emission control line and a corresponding said power supply line;

a gate line driving circuit for supplying the plurality of gate lines with a plurality of scan signals;

a data line driving circuit for sequentially supplying the plurality of data lines with red, green, and blue data signals; and an emission control signal generating circuit for supplying the plurality of emission control lines with red, green, and blue emission control signals, wherein each said pixel includes red, green, and blue electroluminescent elements, which are configured to sequentially emit light based on the red, green, and blue emission control signals per each of a plurality of subframes that form one frame, and wherein the emission control signal generating circuit includes:

a shift register for generating the green emission control signal as an output signal and for transmitting said output signal directly to at least one of the pixels for controlling emission of the green electroluminescent element of the at least one of the pixels;

a first NAND gate for generating the red emission control signal using the output signal of the shift register and an external control signal as two inputs and for transmitting said red emission control signal to the at least one of the pixels for controlling emission of the red electroluminescent element of the at least one of the pixels;

an inverting gate for inverting the external control signal to generate an inverted external control signal; and a second NAND gate for generating the blue emission control signal using the inverted external control signal and the output signal of the shift register as two inputs and for transmitting said blue emission control signal to the at least one of the pixels for controlling emission of the blue electroluminescent element of the at least one of the pixels.

14. A method for driving an organic light emitting diode display comprising a plurality of pixels, each said pixel including red, green, and blue electroluminescent elements, emission of said elements being controlled by red, green, and blue emission control signals, the method comprising:

generating the green emission control signal during a first subframe among a plurality of subframes that form one frame to emit the green electroluminescent element;

generating the red emission control signal using the green emission control signal during a second said subframe to emit the red electroluminescent element;

generating the blue emission control signal using the green emission control signal during a third said subframe to emit the blue electroluminescent element; and maintaining the electroluminescent elements to be a black color during a rest subframe among the plurality of subframes.

15. A method for driving an organic light emitting diode display comprising a plurality of pixels, each said pixel including red, green, and blue electroluminescent elements, emission of said elements being controlled by red, green, and blue emission control signals, the method comprising:

generating the green emission control signal during a first subframe among a plurality of subframes that form one frame to emit the green electroluminescent element;

generating the red emission control signal using the green emission control signal during a second said subframe to emit the red electroluminescent element;

generating the blue emission control signal using the green emission control signal during a third said subframe to emit the blue electroluminescent element; and emitting one of the red, green, or blue electroluminescent elements during a rest subframe among the plurality of subframes.

* * * * *